US006871478B2

(12) United States Patent
Edwards

(10) Patent No.: US 6,871,478 B2
(45) Date of Patent: Mar. 29, 2005

(54) APPARATUS AND METHOD FOR ASSEMBLING FILLED BAG IN BOX CONTAINERS

(75) Inventor: Simon P. Edwards, Irvine, CA (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 10/356,818

(22) Filed: Feb. 3, 2003

(65) Prior Publication Data

US 2004/0148910 A1 Aug. 5, 2004

(51) Int. Cl.[7] ..... B65B 11/58; B65B 5/10

(52) U.S. Cl. ..... 53/449; 53/244; 53/249; 53/389.5

(58) Field of Search ..... 53/389.1, 389.4, 53/389.5, 449, 467, 535, 540, 171, 235, 244, 249, 251, 260

(56) References Cited

U.S. PATENT DOCUMENTS

| | | | | | |
|---|---|---|---|---|---|
| 3,479,795 | A | | 11/1969 | Martin | |
| 3,512,336 | A | | 5/1970 | Rosecrans | |
| 3,641,735 | A | * | 2/1972 | Daily et al. | 53/537 |
| 3,676,978 | A | | 7/1972 | Gottweis et al. | |
| 3,729,895 | A | * | 5/1973 | Kramer et al. | 53/244 |
| 3,996,723 | A | * | 12/1976 | Greenwell | 53/537 |
| 4,081,096 | A | | 3/1978 | Kupcikevicius | |
| 4,398,383 | A | * | 8/1983 | Prakken | 53/537 |
| 4,570,418 | A | | 2/1986 | Gino | |
| 4,608,808 | A | * | 9/1986 | Ryan et al. | 53/535 |
| 4,676,050 | A | * | 6/1987 | Odenthal | 53/449 |
| 4,731,975 | A | * | 3/1988 | Rossier | 53/537 |
| 4,800,703 | A | | 1/1989 | Goodman | |
| 4,864,801 | A | * | 9/1989 | Fallas | 53/540 |
| 5,117,614 | A | * | 6/1992 | Johnsen | 53/540 |
| 5,195,305 | A | * | 3/1993 | Dambrosio et al. | 53/260 |
| 5,528,883 | A | | 6/1996 | Jamison | |
| 5,588,285 | A | | 12/1996 | Odenthal | |
| 5,605,031 | A | | 2/1997 | Prakken | |
| 5,813,196 | A | * | 9/1998 | Page et al. | 53/449 |
| 5,855,105 | A | * | 1/1999 | Ferris | 53/540 |
| 6,061,996 | A | | 5/2000 | Vissers et al. | |
| 6,248,052 | B1 | | 6/2001 | Kleeberger et al. | |

* cited by examiner

*Primary Examiner*—Louis Huynh
(74) *Attorney, Agent, or Firm*—King & Jovanovic, PLC

(57) ABSTRACT

A container assembly apparatus associatable with a filler device. The container assembly apparatus being capable of positioning an inner flexible container filled by a filler device into an outer container. The container assembly apparatus comprises a transfer device and an outer container drive system. The transfer device comprises a conveyor including a first region and a second region. The first region is associatable with a filler device and the second region is positioned in an orientation which is substantially oblique to the first region. The outer container drive system is capable of positioning an outer container proximate an end of the second region of the conveyor of the transfer device.

14 Claims, 4 Drawing Sheets

APPARATUS AND METHOD FOR ASSEMBLING FILLED BAG IN BOX CONTAINERS

BACKGROUND OF THE INVENTION

1. Field of the Invention

The present invention relates in general to bag in box handling equipment, and more particularly to an apparatus and method for assembling filled bags into outer containers, to, in turn, join a bag in box container.

2. Background Art

The use of bag in box containers has become increasingly popular. The containers are generally utilized in association with a variety of different liquids and solids. Bag in box containers generally comprise a flexible inner container and a substantially rigid outer container. The flexible inner container includes a spout and the rigid outer container often includes an opening which is designed to cooperate with the spout for discharge.

A great focus has been made in the filling industry relative to bag in box containers. A number of automated solutions have been developed for filling the flexible inner container. The placement of the flexible inner container within the outer container, and the proper orientation of the inner container relative to the outer container, has generally been a labor intensive and time intensive task. Due to the focus on filling equipment, today's inner flexible containers can be filled at increasingly greater rates. Unfortunately, the assembly of the flexible inner container into the outer container has not benefited from the same advancement. Consequently, the final assembly of filled flexible containers into the substantially rigid outer container has become a major constraint relative to increased efficiency.

Accordingly, it is an object of the invention to overcome the deficiencies in the prior art. For example, it is an object of the present invention to improve the assembly of bag in box containers.

It is an additional object of the present invention to improve placement of a filled flexible container in a desired orientation within a rigid outer container.

These objects as well as other objects of the present invention will become apparent in light of the present specification, claims, and drawings.

SUMMARY OF THE INVENTION

The invention comprises a container assembly apparatus associatable with a filler device. The container assembly apparatus is capable of positioning an inner flexible container filled by a filler device into an outer container and comprises a transfer device and an outer container drive system. The transfer device comprises a conveyor including a first region and a second region. The first region is associatable with a filler device and the second region is positioned in an orientation which is substantially oblique to the first region. The outer container drive system is capable of positioning an outer container proximate an end of the second region of the conveyor of the transfer device.

In a preferred embodiment, the transfer device further comprises a manipulating assembly associated with the second region of the conveyor. In one embodiment, the manipulating assembly comprises at least one side wall positioned at an angle oblique to a direction of travel of the second region of the conveyor. In another such embodiment, the at least one side wall comprises at least one pair of side walls positioned on opposing sides of the second region of the conveyor. In another such embodiment, the manipulating assembly comprises an upper wall positioned so as to overlie a portion of the second region in a spaced apart orientation therefrom.

In one such embodiment, the manipulating assembly comprises an upper wall positioned so as to overlie a portion of the second region in a spaced apart orientation therefrom.

Preferably, the first region is substantially horizontal and the second region is positioned at an angle of between 120° and 170°. In another preferred embodiment, the conveyor comprises a belt conveyor which operates at a substantially constant linear speed. In another embodiment, the conveyor comprises a plurality of rollers which are inclined at respective angles in each of the first and second regions thereof. The rollers are preferably configured to resist rotation at a predetermined level, to, in turn, achieve a controlled movement of the container thereralong.

In another preferred embodiment, the outer container drive system further comprises an outer conveyor capable of positioning an outer container in a desired predetermined orientation.

The invention further comprises a method of assembling a container comprising the steps of filling an inner flexible container with a filler device; placing the filled inner flexible container on the first region of a conveyor; directing the filled inner flexible container along the first region of a conveyor; transferring the filled inner flexible container onto a second region of the conveyor, the second region being positioned in an orientation which is substantially oblique to the first region; directing the filled inner flexible container along the second region of the conveyor; positioning an outer container in a desired orientation relative to the second region of the conveyor; and directing the inner flexible container into the outer container.

In one embodiment, the method further comprises the step of manipulating the inner flexible container into a desired orientation as the container is directed along the second region of the container.

In another embodiment, the step of placing further comprises the step of placing the filled inner flexible container on the first region of a conveyor in a predetermined orientation. Further, the step of directing further comprises the step of inserting the filled inner flexible container into the outer container in a predetermined orientation.

In yet another aspect of the invention, the invention further comprises a method of assembling a plurality of containers comprising the steps of filling a plurality of inner flexible containers with a filler device; sequentially placing filled inner flexible containers on the first region of a conveyor; sequentially directing the filled inner flexible containers along the first region of a conveyor; sequentially transferring the filled inner flexible containers onto a second region of the conveyor, the second region being positioned in an orientation which is substantially oblique to the first region; sequentially directing the filled inner flexible container along the second region of the conveyor; sequentially positioning outer containers in a predetermined orientation relative to the second region of the conveyor; and directing each inner flexible container into a desired outer container.

BRIEF DESCRIPTION OF THE DRAWINGS

The invention will now be described with reference to the drawings wherein.

DETAILED DESCRIPTION OF THE INVENTION

Figure 1:
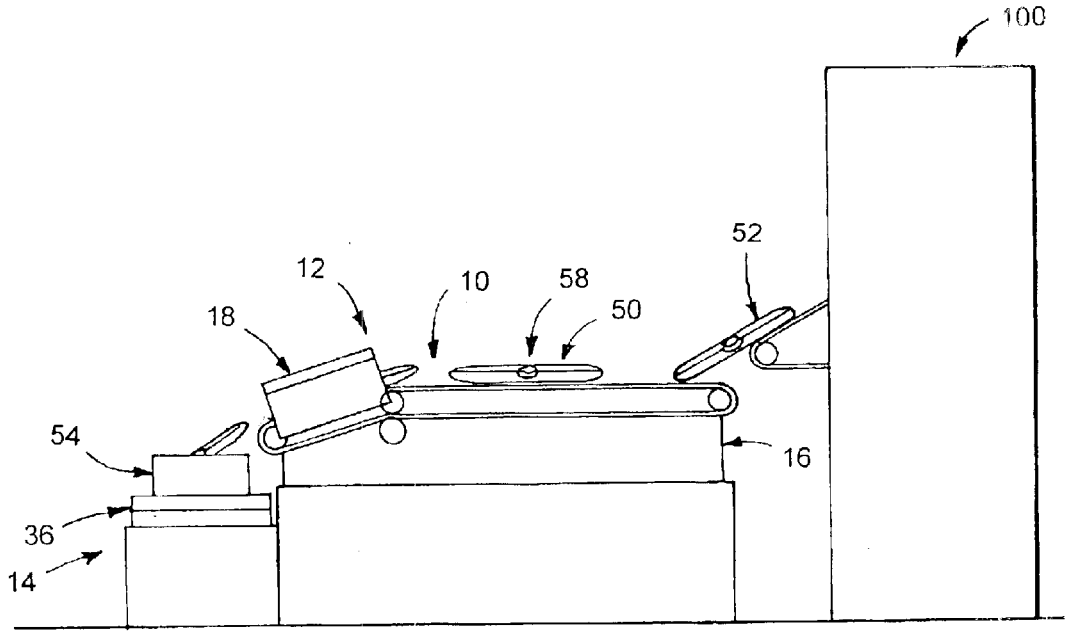
FIG. 1 of the drawings is a side elevational view of the container assembly apparatus of the present invention along with a filler device.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
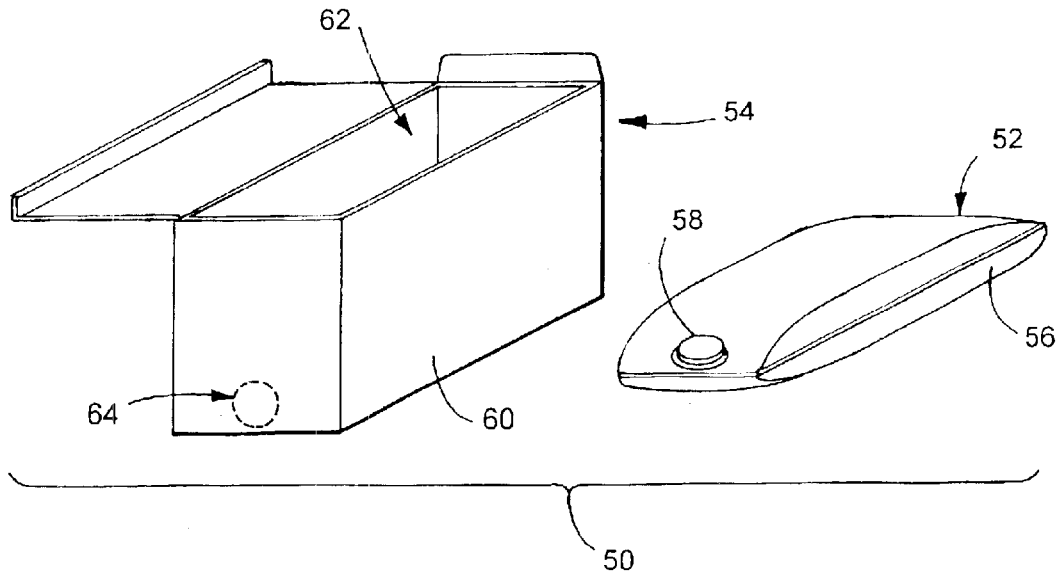
FIG. 2 of the drawings is a perspective view of a container comprising an inner flexible container and an outer container.

Referring now to the drawings and in particular to FIG. 1, container assembly apparatus 10 comprises transfer device 12 and outer container drive assembly 14. The container assembly apparatus is designed for use in association with filler device 100 to assemble containers, such as container 50 (FIG. 2). Filler device 100 may comprise any number of different filler devices which may be rotary filler devices, indexed filler devices, sequential filler devices, among others. Indeed, the type of filler device to which container assembly 10 is mounted may be varied and is not limited to any particular filler device.

One embodiment of container 50 is shown in FIG. 2 in detail as generally including inner flexible container 52 and outer container 54. Inner flexible container 52 generally comprises a plurality of panels 56 and fitment 58 (although a fitmentless inner flexible container is likewise contemplated). Depending on the particular embodiment, the plurality of panels may form a pillow flexible container. Of course, it is likewise contemplated that the panels may form a form fitted container or a custom dimensioned container. The panels maybe connected byway of heat sealing, RF sealing, adhesive sealing, etc. Fitment 58 extends through at least one of the plurality of panels, such that the fitment may be utilized for filling and/or for discharging the contents of the inner flexible container. Of course, fitment 58 is not limited to any particular configuration, and, indeed, the fitment may comprise any number of different constructions suitable for use in association with such flexible containers.

Outer container 54 comprises a plurality of walls, such as wall 60 and may include fitment region 64. In the embodiment shown, the plurality of walls cooperate to define a substantially rectangular box. Of course, the particular shape and orientation of the walls can be varied and is not limited to the embodiment shown. Fitment region 64 is shown in FIG. 2 as being associated with one of the plurality of walls. In the embodiment shown, the fitment region includes an opening through which fitment 58 can be extended for discharge. While not required, in many embodiments, the opening of fitment region 64 may be perforated to facilitate the puncturing and positioning of the fitment therethrough.

Figure 3:
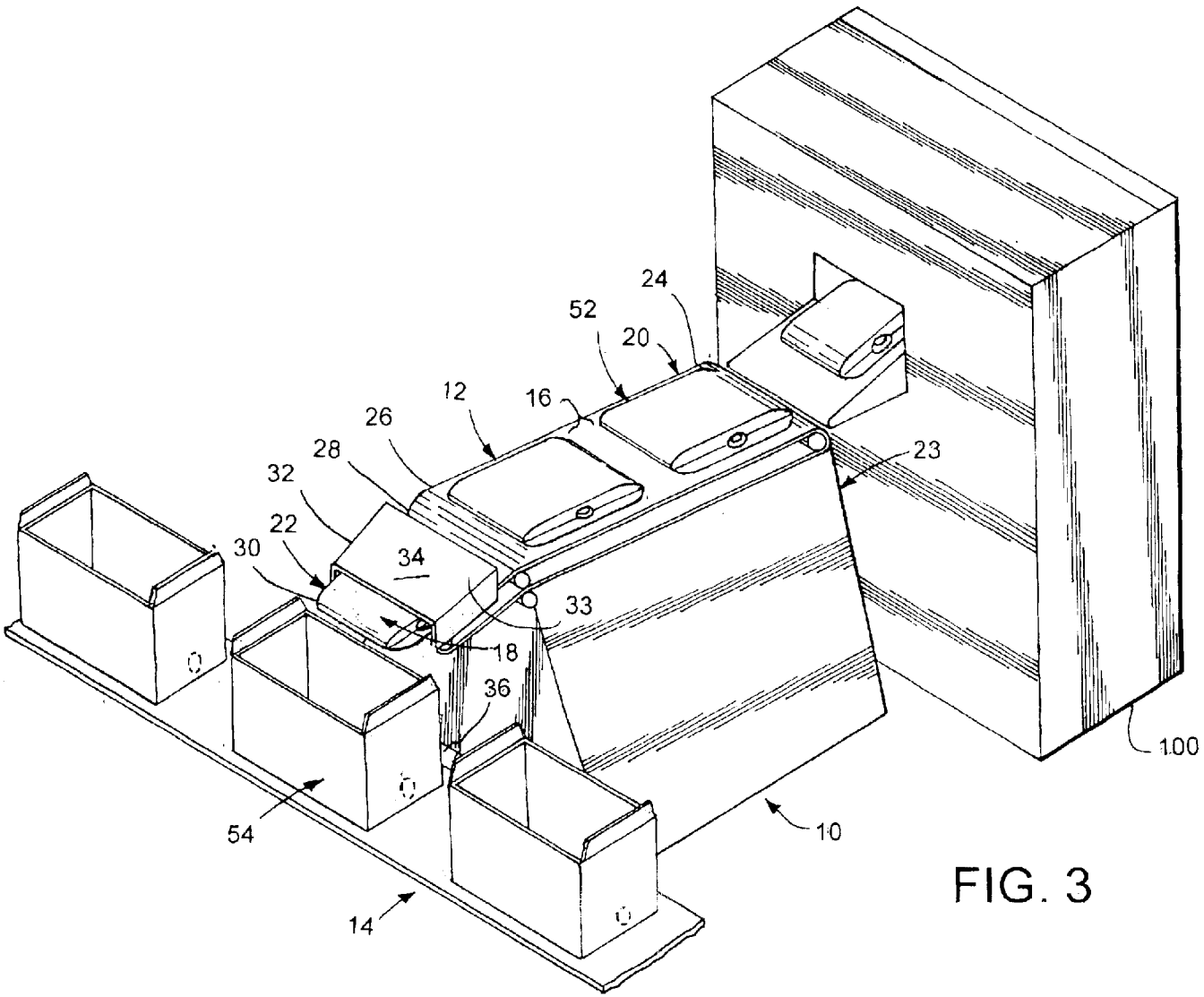
FIG. 3 of the drawings is a perspective view of the container assembly apparatus of the present invention along with a filler device.

Referring to FIG. 3, transfer device 12 of container assembly apparatus 10 comprises conveyor 16 and manipulating assembly 18. Conveyor 16 includes first region 20 and second region 22 and means 23 for advancing the container. First region 20 includes first end 24 and second end 26. Second region 22 includes first end 28 and second end 30. First end 28 of second region 22 abuts second end 26 of first region 20. First region 20 and second region 22 are positioned such that they are oblique to each other. For example, first region 20 is substantially horizontal, and second region 22 extends at an outwardly downward direction therefrom. For example, the first and second regions may be orientated at an angle $\alpha$ which may range from about 120° to 170°, and more preferably between 135° and 150°. Of course, the precise angle at which the first and second regions are positioned may be varied depending on the particular embodiment. In the embodiment shown, the conveyor comprises a belt conveyor.

The container advancing means 23 may comprise, for example, an electric motor associated with one of the axles of the conveyor. Of course, the container advancing means is not limited to any particular assembly or device. The conveyor spans the first and second region of the conveyor. As such, the linear speed of the conveyor (i.e., belt conveyor) proximate the first and second regions is substantially uniform. Of course, it is contemplated that multiple conveyors may be utilized (i.e., one conveyor for the first region and one conveyor for the second region), wherein the separate conveyors can be maintained at substantially similar speeds.

It is contemplated in other embodiments that the conveyor may be divided into in excess of two regions, and each of the regions may be disposed such that they are oblique to each other. The different regions may be coupled with a single conveyor, or may include multiple conveyors which are positioned in abutment. As such the angle a may comprise a compound angle which increases between adjoining conveyor components (i.e., in a system having multiple regions in excess of two). It will be understood that the second region generally refers to the final region of substantial contact prior to the substantial release of the inner container from the conveyor.

Figure 5:
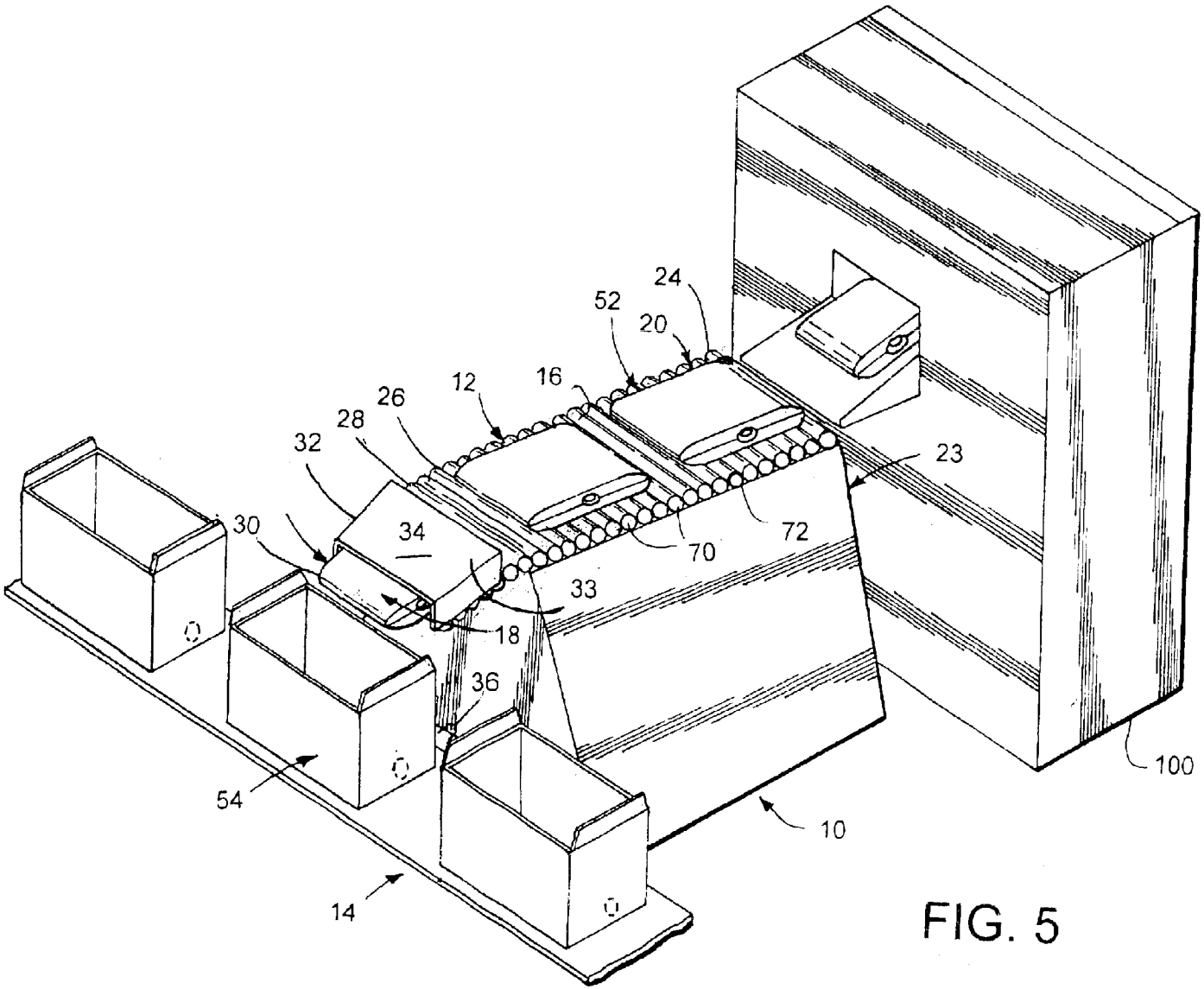
FIG. 5 of the drawings is a side elevational view of an embodiment the container assembly apparatus of the present invention along with a filler device.

In another embodiment of the invention, as is shown in FIG. 5, first region 20 of conveyor 16 may comprise a plurality of rollers, such as rollers 70, arranged sequentially within frame 72. Second region 22 of conveyor 16 may likewise comprise a plurality of rollers, such as rollers 70. As with the embodiment of FIG. 3, the first and second regions may be angled relative each other at angles of approximately between 135° and 150°. In certain embodiments, one of first region 20 and second region 22 may comprise a plurality of rollers and the other may comprise a conveyor of the type identified in FIG. 3 (i.e., a conveyor having a moving belt surface).

In the embodiment of FIG. 5, container advancing means may comprise the positioning of frame 72, and rollers 70, at a slight angle relative to the horizontal. Such an angle may be between, for example, 3° and 10°. Such an angle, combined with the low friction of the rollers, permits the moving of the container along the rollers, with only a very slight acceleration (i.e., the velocity of the expended container will not be substantially different between the first and second end of the first region of conveyor 16). Indeed, the rollers can be configured to provide a predetermined resistance to rotation, to, in turn, control the velocity of the container therealong. Additionally, the rollers maintain full contact with and substantially control the movement of the container, to, in turn, provide a controlled travel into the outer container.

Figure 6:
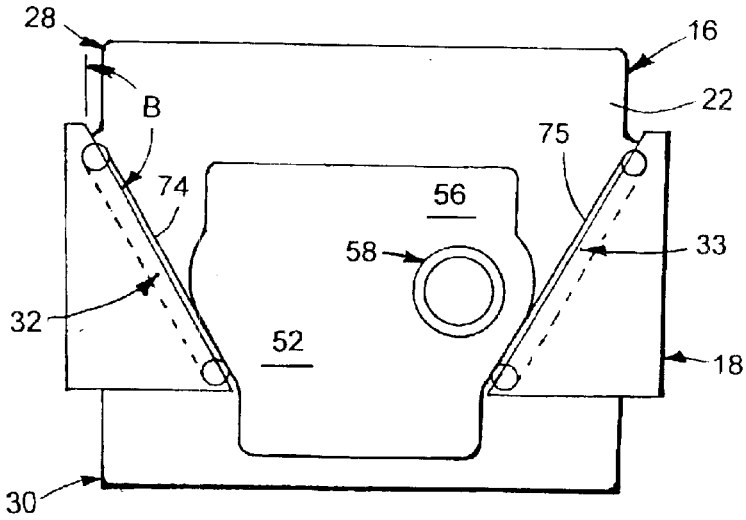
FIG. 6 of the drawings is a side elevational view of the container assembly apparatus of the present invention showing, in particular, another embodiment of the second region of the conveyor and the manipulating assembly.

Manipulating assembly 18 is shown in FIG. 3 as comprising side walls 32, 33 and upper wall 34. Side walls 32, 33 are shown in detail in FIG. 4 as extending substantially over at least a portion of second region 22. In the embodiment shown sidewalls 32, 33 are inclined so as to be oblique to the direction of travel of the conveyor. For example, the side walls may be positioned at angle β relative to the travel of the inner flexible container. It is contemplated that angle β is between 135° and 175°. Of course, it is contemplated that each side wall may be positioned at a different angle β, and that the precise angle can be varied depending upon the particular embodiment. As is shown in FIG. 6, side walls 32, 33 may be augmented with conveyors 74, 75 (i.e., belt conveyors, roller conveyors, etc.) which further facilitate the movement of the container therealong.

Figure 7:
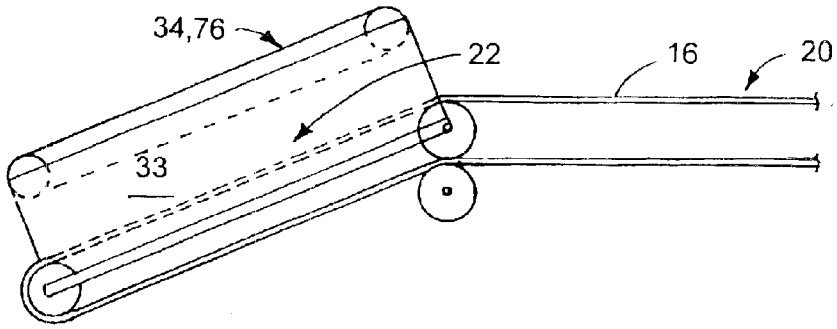
FIG. 7 of the drawings is a front plan view of the container assembly apparatus of the present invention showing, in particular, the second region of the conveyor and the manipulating assembly.

Referring again to FIG. 3, upper wall 34 extends in an overlying position relative to second region 22 of conveyor 16. The upper wall may be positioned substantially parallel to second region 22 or may be oblique thereto in an orientation which is spaced apart from the conveyor a predetermined distance. In other embodiments, such as the embodiment shown in FIG. 7, upper wall 34 may comprise a separate conveyor 76 (i.e., belt conveyor, roller conveyor, etc.) which further facilitates the handling of the container positioned thereon. Such an embodiment may cooperate with side walls which likewise include a separate conveyor. As will be explained, the manipulating assembly displaces the liquid contained within the liner to control the configuration of the container, and the footprint of the container on the conveyor, to, in turn, control the position of inner container relative to the outer container upon the joining of same.

Of course, in certain embodiments, one or more of the side walls and the upper wall of the manipulating assembly may be optionally excluded. It is likewise contemplated that additional side walls may be positioned along strategic positions of the first region. In systems which include more than two regions, the side walls may be positioned along any one of the regions, and most preferably proximate the final region of the conveyor.

Outer container drive system 14 is shown in FIGS. 1 and 3 as comprising conveyor 36. Conveyor 36 may be substantially horizontal or may be angled relative to a horizontal plane so as to place the opening of the outer container in an optimal position to receive an inner flexible container. Conveyor 36 is capable of directing outer containers in a desired orientation relative to conveyor 16 so as to be in a position to receive inner flexible container 52. Once the inner flexible container is received, conveyor 36 is configured to remove the filled container and to optionally place a subsequent unfilled outer container in the proper orientation.

Referring again to FIG. 1, in operation, inner flexible container 52 is associated with filler device 100 such that filler device 100 can fill the flexible container through fitment 58 and subsequently cap the container. Filler device 100 discharges the filled and capped container onto transfer device 12 of container assembly apparatus.

Specifically, as is shown in FIG. 3, the filled inner flexible container is positioned upon first region 20 of conveyor 16. Conveyor 16 is driven by conveyor advancing means at a predetermined speed. As the conveyor is advanced, the flexible container proceeds across first region 20 from first end 24 to second end 26 thereof. The inner flexible container is subsequently directed onto second region proximate first end 28 thereof (i.e., the inner container proceeds in a generally inclined direction oblique to the first region). Similarly, with an embodiment which includes rollers instead of a belt conveyor, the resistance to rotation of the rollers can be controlled to achieve a desired controlled travel of the container therealong.

Figure 4:
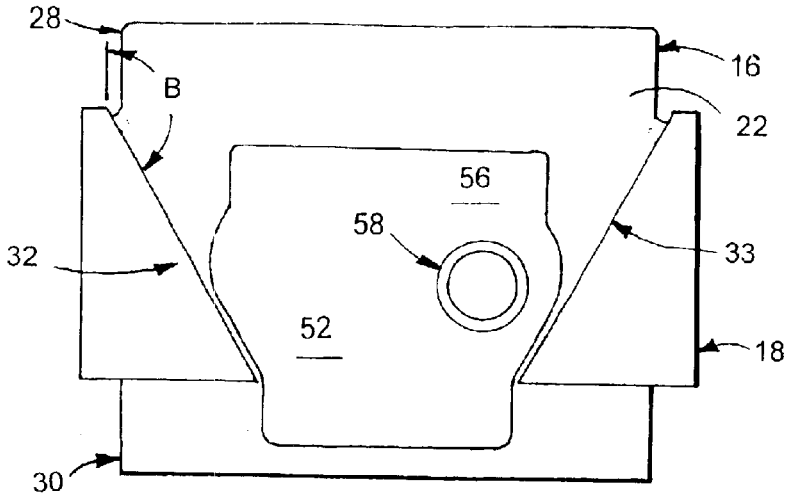
FIG. 4 of the drawings is a front plan view of the container assembly apparatus of the present invention showing, in particular, the second region of the conveyor and the manipulating assembly.

Referring now to FIG. 4, as the container proceeds along the second region, the manipulating assembly contacts and manipulates the position and orientation of the container. In particular, the side walls act upon the container (and the fluid within the container), to alter the footprint of the container on the second region of the conveyor. In addition, by altering the footprint of the container the position of the fitment may be further reoriented. As the inner flexible container proceeds onto the second region, a component of the velocity is directed in a direction other than horizontal along the second region. As such, upper wall 34 is positioned to overlie a portion of the second region to insure movement of the inner flexible container as desired along the second region.

Referring again to FIGS. 1 and 3, as the inner container proceeds along second region 22 toward the second end thereof, outer conveyor 36 of outer container drive system 14 is activated so as to direct a corresponding outer container 54 in a proper orientation relative to second end 30 of the second region of conveyor 16. As such, as the inner container proceeds beyond second end 30 of the second region, the inner container is directed into outer container 54.

Advantageously, inasmuch as the inner container is controllably directed from the filler device to the outer container (or in the embodiment having rollers, in a controlled manner), any container positioned along the conveyor will behave substantially identically along the transfer device. As such, by positioning an inner container in a specific position proximate first end 24 of first region 20, the resulting position of the inner container proximate second end 30 of second region 22 is predictable and known (i.e., substantially the same every time the inner container is positioned in the specific position). Inasmuch as the outer container can be positioned as desired, it is possible to obtain the proper positioning and orientation of the inner container within the outer container based upon the introduction position of the filled inner container upon introduction into transfer device 12. Accordingly, it is possible to properly orientate the inner flexible container and the outer container such that fitment 58 of the inner flexible container predictably consistently corresponds to fitment region 64 of the outer container.

Indeed, each of filler device 100, transfer device 12 and outer container drive system 14 may be coordinated to operate continuously and in substantial unison such that the transfer device can continuously assemble inner containers into outer containers to complete the assembly of a bag in box container. Of course, it will be understood that a single outer container may be configured such that multiple inner containers are directed into the single outer container.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A method of assembling a container comprising the steps of:

filling an inner flexible container with a filler device;

placing the filled inner flexible container on a first region of a conveyor, the first region of the conveyor including a movable surface upon which the filed inner flexible container travels;

firstly directing the filled inner flexible container along the first region of the conveyor;

transferring the filled inner flexible container onto a second region of the conveyor, the second region being positioned in an orientation which is substantially oblique to the first region, and the second region of the conveyor including a movable surface upon which the filled inner flexible container travels;

secondly directing the filled inner flexible container along the second region of the conveyor;

manipulating the filled inner flexible container into a desired orientation as the container is directed along the second region of the conveyor through a manipulating assembly having at least one sidewall extending substantially inwardly and overlying at least a portion of the second region of the conveyor and fixedly positioned at an angle oblique to a direction of travel of the second region of the conveyor;

positioning an outer container in a desired orientation relative to the second region of the conveyor; and thirdly directing the inner flexible container into the outer container.

2. The method of claim 1 wherein:

the step of placing further comprises the step of placing the filled inner flexible container on the first region of a conveyor in a predetermined orientation; and the step of directing further comprises the step of inserting the filled inner flexible container into the outer container in a predetermined orientation.

3. The method of claim 1 wherein:

the step of placing further comprises the step of placing the filled inner flexible container on the first region of the conveyor in a predetermined orientation; and the step of thirdly directing further comprises the step of inserting the filled inner flexible container into the outer container in a predetermined orientation.

4. A method of assembling a plurality of containers comprising the steps of:

filling a plurality of inner flexible containers with a filler device;

sequentially placing filled inner flexible containers on the first region of a conveyor, the first region of the conveyor including a movable surface upon which the filled inner flexible container travels;

sequentially firstly directing the filled inner flexible containers along the first region of the conveyor, a second region of the conveyor including a movable surface upon which the filled inner flexible travels;

sequentially transferring the filled inner flexible containers onto the second region of the conveyor, the second region being positioned in an orientation which is substantially oblique to the first region;

sequentially secondly directing the filled inner flexible container along the second region of the conveyor;

manipulating the field inner flexible container into a desired orientation as the container is directed along the second region of the conveyor through a manipulating assembly at least one sidewall extending substantially inwardly and overlying at least a portion of the second region of the conveyor and fixedly positioned at an angle oblique to a direction of travel of the second region of the conveyor;

sequentially positioning outer containers in a predetermined orientation relative to the second region of the conveyor; and thirdly directing each inner flexible container into a properly positioned outer container.

5. The method of claim 4 wherein the step of directing comprises the step of directing comprises the step of directing multiple inner flexible containers into a single outer container.

6. A container assembly apparatus associatable with a filler device, the container assembly apparatus capable of positioning an inner flexible container filled by a filler device into an outer container, the container assembly apparatus comprising:

a transfer device comprising:

a conveyor including:

a first region and a second region, the first region associatable with a filler device and the second region being positioned in an orientatiowhich is substantially oblique to the first region, wherein each of the first region and the second region include at least one movable surface along which an inner flexible container is capable of traveling; and a manipulating assembly associated with the second region of the conveyor, the manipulating assembly comprising at least one side wall extending substantially inwardly and overlying at least a portion of the second region of the conveyor and fixedly positioned at an angle oblique to a direction of travel of the second region of the conveyor; and an outer container drive system, the outer container drive system capable of positioning an outer container proximate an end of the second region of the conveyor of the transfer device.

7. The container assembly apparatus of claim 6 wherein the at least one side wall comprises at least one pair of side walls extending substantially over at least a portion of the second region of the conveyor and positioned on opposing sides of the second region of the conveyor.

8. The container assembly apparatus of claim 7 wherein the manipulating assembly comprises:

an upper wall positioned so as to overlie a portion of the second region in a spaced apart orientation therefrom.

9. The container assembly apparatus of claim 6 wherein the manipulating assembly comprises:

an upper wall positioned so as to overlie a portion of the second region in a spaced apart orientation therefrom.

10. The container assembly apparatus of claim 6 wherein the first region is substantially horizontal.

11. The container assembly apparatus of claim 10 wherein the second region is positioned at an angle of between 120° and 170°.

12. The container assembly apparatus of claim 6 wherein the conveyor comprises a belt conveyor having a substantially constant linear speed.

13. The container assembly apparatus of claim 6 wherein the conveyor comprises a plurality of rollers mounted upon a frame, the rollers of the first region being configured at a downward angle relative to a horizontal axis toward the second region.

14. The container assembly apparatus of claim 6 wherein the outer container drive system further comprises an outer conveyor capable of positioning an outer container in a desired predetermined orientation.

* * * * *

UNITED STATES PATENT AND TRADEMARK OFFICE

CERTIFICATE OF CORRECTION

PATENT NO. : 6,871,478 B2
DATED : March 29, 2005
INVENTOR(S) : Edwards

It is certified that error appears in the above-identified patent and that said Letters Patent is hereby corrected as shown below:

Column 2,
Line 18, delete “thereralong.” and substitute -- therealong. --.

Column 3,
Line 12, after “embodiment” insert -- of --.
Line 61, delete “byway” and substitute -- by way --.

Column 4,
Line 49, delete “angle a may” insert -- angle α may --.
Line 62, after “angled relative” insert -- to --.

Column 5,
Line 7, delete “expended” and substitute -- expanded --.

Column 7,
Line 11, delete “the filed inner” and substitute -- the filled inner --.
Line 41, after “the step of” insert -- thirdly --.
Line 55, delete “containers on the” and substitute -- containers on a --.

Column 8,
Line 3, delete “the field inner” and substitute -- the filled inner --.
Line 31, delete “orientatiowhich” and substitute -- orientation which --.

Signed and Sealed this

Nineteenth Day of July, 2005

JON W. DUDAS
*Director of the United States Patent and Trademark Office*